United States Patent [19]

Pigna

[11] Patent Number: 4,610,590

[45] Date of Patent: Sep. 9, 1986

[54] AUTOMATIC PUNCHING AND WIRE COMB BINDING MACHINE

[75] Inventor: Daniele P. Pigna, Bergamo, Italy

[73] Assignee: Rilecart S.p.A., Nembro, Italy

[21] Appl. No.: 499,718

[22] Filed: May 31, 1983

[30] Foreign Application Priority Data

Jun. 4, 1982 [IT] Italy ..... 21715 A/82

[51] Int. Cl.[4] ..... B42B 5/10; B42C 3/00

[52] U.S. Cl. ..... 412/11; 412/7; 412/13; 412/38; 412/39

[58] Field of Search ..... 412/7, 11, 13, 38, 39, 412/40; 281/25 A; 270/53; 271/221, 222

[56] References Cited

U.S. PATENT DOCUMENTS

| | | | |
|---|---|---|---|
| 3,334,918 | 8/1967 | Pigna et al. | 412/7 X |
| 3,555,587 | 1/1971 | Seaborn | 412/7 |
| 3,627,312 | 12/1971 | Fackler et al. | 271/221 |
| 3,667,076 | 6/1972 | Aglaghanian et al. | 412/39 |
| 3,854,158 | 12/1974 | Pigna et al. | 412/39 |
| 3,883,916 | 5/1975 | Adams et al. | 412/39 |
| 3,889,309 | 6/1975 | Adams et al. | 412/39 |
| 3,967,336 | 7/1976 | Cutter | 412/13 |
| 4,129,913 | 12/1978 | Pfaffle | 412/39 |
| 4,320,547 | 3/1982 | Stolle et al. | 412/40 |

FOREIGN PATENT DOCUMENTS

| | | | |
|---|---|---|---|
| 8103463 | 12/1981 | World Int. Prop. O. | 412/39 |
| 1405136 | 9/1975 | United Kingdom | 412/39 |

*Primary Examiner*—Robert L. Spruill
*Assistant Examiner*—Taylor J. Ross
*Attorney, Agent, or Firm*—Seidel, Gonda, Goldhammer & Abbott

[57] ABSTRACT

An automatic machine for perforating and comb binding blocks of loose sheets. The control of the movements of the punching and binding mechanisms is centralized. The machine is capable of making perforations and thus bindings which are either continuous or in the form of portions separated in a manner which can be preset as desired. Feed of the sheets to be perforated and bound is effected by chains provided with fixed brackets with corresponding movable tabs which can withdraw into or project out of the conveying surface. The movement of the tabs is coordinated with that of the chains and of the punching mechanism. The feed of the comb binding to the coupling station is effected by two independent brake-friction units, controlled separately by presettable digital controls.

12 Claims, 5 Drawing Figures

AUTOMATIC PUNCHING AND WIRE COMB BINDING MACHINE

BACKGROUND OF THE INVENTION

This invention relates to a machine for automatically perforating and comb binding blocks of loose sheets, and which makes provision for the insertion of hooks, for example in the preparation of wall calendars.

Binding machines for already perforated loose sheets are known, both of automatic type in which the binding elements, precut or continuously withdrawn from a feed reel, are engaged with and then inserted into the sheets without manual intervention, and of semiautomatic type in which it is possible to select and predetermine the number of comb loops to be cut off and inserted into the sheets, this possibly being non-continuous, but in which the engagement between the binding elements and the sheets takes place under static conditions by manually presenting the group of sheets to be bound in the engagement and fastening station. A semiautomatic machine of this type is for example described and claimed in Italian Pat. No. 959,769 corresponding to U.S. Pat. No. 3,854,158.

There are other devices which in order to form wall calendars, for example provide for automatically inserting the hook necessary for this purpose during the actual binding operations, i.e. at the moment of fastening the binding element. A machine of this type is described and claimed in Italian patent application No. 28738 A/76.

However, the requirement for a machine which can continuously and automatically bind sheets, including those which have not previously been perforated, and possibly over lengths spaced-apart at choice and with the intermediate insertion of a hook, as provided in the production of wall calendars, had remained unsatisfied.

SUMMARY OF THE INVENTION

The object of the present invention is to provide a machine which carries out all the above operations on sheets being continuously and automatically fed along it, comprising also the perforation operation and thus dispensing with the idle times involved in passage from one machine to another, together with the need for personnel to remove the material which has undergone a certain operation and feed it to the machine which carries out the next operation.

The machine according to the present invention comprises a sheet perforating station comprising a vertically mobile matrix of replaceable punches, and a station for engaging the perforated sheets with the binding element which is fed continuously from a reel by way of two differing independent feed members comprising an intermediate cutting member. The machine is housed substantially in a single support and cover frame, part of which in the form of an inclined surface provides the support and feed surface for the work. The binding station is associated with a known hook insertion device. The machine also includes press means of known type, and means for conveying the blocks of sheets along said feed surface, said conveying means being associted with tab means in proximity to said two stations and in a final discharge zone which are capable of positioning said blocks in front of said stations in correspondence with a stoppage of said conveyor means. The motion of the conveyor means, of said tabs and of said punches is controlled by a single motor means. The machine also comprising an electronic programmer arranged to receive as input the signals originating from a group of cams connected to said conveyor means and to said motor means for moving said tabs, and from a means responsive to the feed of the binding comb and arranged to count the number of comb loops by which said comb is fed. The programmer being able to actuate, as a function of at least one value preset on a selector, an operational sequence which controls the differing feed members of the binding element, the cutting member, the insertion of the hook, and the closure of the press.

Said machine therefore comprises mechanical members controlled by a single main motor by way of various linkages, an electronic programming unit, the input of which is connected inter alia to said mechanical units and which can be preset by means of digital selectors preferably on the basis of four values of which the unit is the loop pitch of the binding comb, and of which the number is suitably "counted", and to a sensor member, preferably a photoelectric cell, which senses the presence of the sheets and provides an authorisation signal to the programmer, and finally comprises other mechanical brake-clutch members controlled directly by the programmer in order to determine the feed of the binding element, and pneumatic means for controlling for example the cutting member and press, of which the solenoid control valves are also operated by said programmer.

BRIEF DESCRIPTION OF THE DRAWINGS

These and further characteristics of the machine according to the present invention will be apparent to those skilled in the art from the detailed description given hereinafter by way of non-limiting example of a preferred embodiment thereof with reference to the accompanying drawings in which.

DETAILED DESCRIPTION OF THE PREFERRED EMBODIMENTS

With reference to the drawings, the machine according to the present invention comprises a support and cover frame 1, comprising a front part in the form of an inclined surface 2 on which the blocks of sheets to be bound are disposed as on a lectern, and are then fed, in this case from right to left. Along the lower edge of the inclined surface 2 there is a longitudinal guide 3 on which the edge of the block to be perforated and then bound rests and slides. Above the inclined surface 2 there may be provided a member 4 for retaining the top of the sheets. Members 4 may be rigid members or elastic strips.

Figure 2:
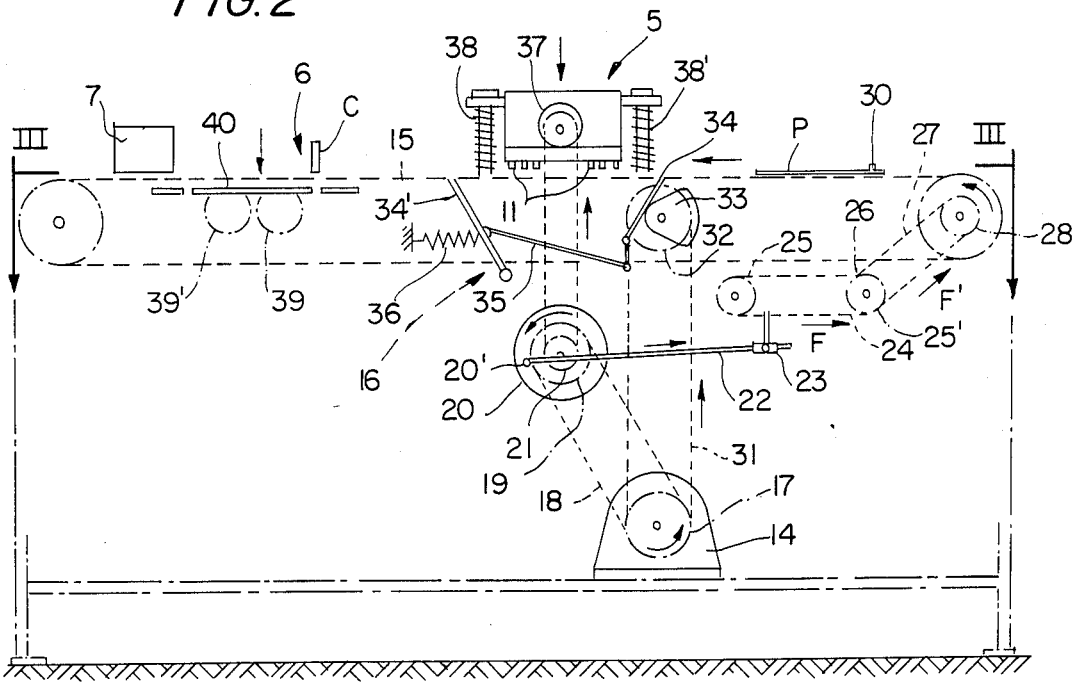
FIG. 2 is a partial diagrammatic view of the main mechanical control unit of the machine upstream of the binding press.

The reference numeral 5 indicates the sheet perforation station which, as is better seen in FIG. 2, comprises a matrix of punches 11, the number of which can be selected according to requirements. At the perforation station, the guide 3 is shaped in such a manner (not shown) as to form a backing plate for the punches and thus facilitate perforation and the removal of the waste material, which is collected externally by way of a discharge chute 12.

The machine also comprises a device 6 for engaging the binding comb 9 with the perforated sheets and then fastening it thereover by means of a press. The machine further comprises a feed reel 8 of the comb 9 and the hook insertion device 7. This latter corresponds substantially to the device which forms the subject matter of Italian patent application No. 28738 A/76 in the name of Cartiere Paolo Pigna S.p.A. The coupling device 6, which is similar to that forming the subject matter of U.S. Pat. No. 3,854,158, also in the name of Cartiere Paolo Pigna S.p.A., especially with regard to the press portion, will be described only in relation to certain innovations introduced herein.

Figure 1:
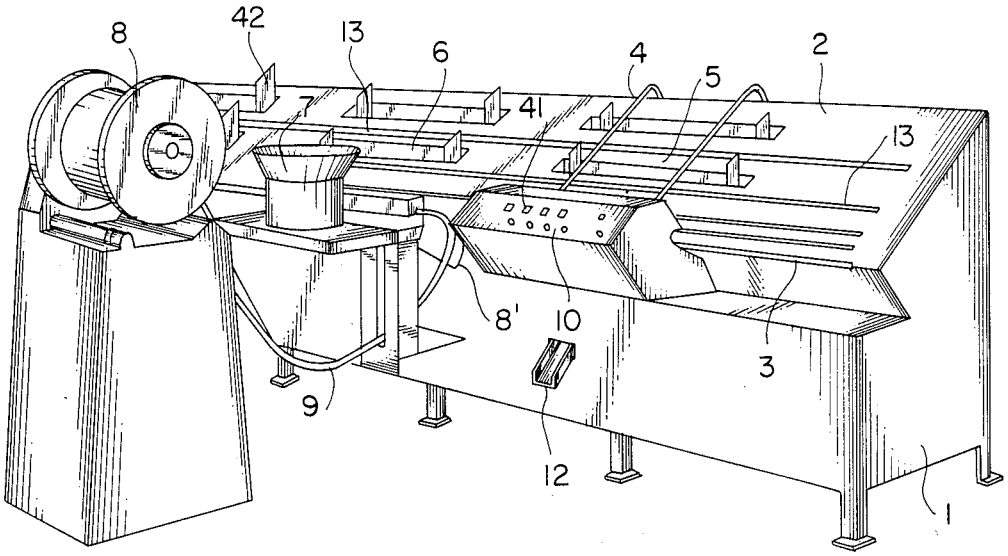
FIG. 1 is a perspective view, simplified to its essential lines, of a machine according to the present invention.

As can be seen in FIG. 1, the inclined surface 2 comprises longitudinal slots 13 which are parallel to each other and parallel to the resting edge 3, and which extend substantially along the entire inclined surface 2. From them project outward the conveyor means tabs which are arranged to push the blocks along the machine path into positions corresponding with the stations 5 and 6. In general, the slots 13 are in such a number and at such a distance from the fixed guide 3 as to ensure correct engagement with the conveyor tabs (described in greater detail hereinafter) for any scheduled size of sheets to be bound. Each slot 13 is of such a width as to enable not only said conveyor tabs to project from the surface 2, but also other tabs disposed preferably in pairs at the stations 5 and 6 and in proximity to the termination of the path on the surface of the machine, at the outlet end thereof. Thus each slot 13 may be either double, separated by a narrow intermediate strip of the surface 2, or single, with a width sufficient to house both the aforesaid tabs placed side by side in the transverse direction of the machine, and described in greater detail hereinafter.

FIG. 2 shows the main machine operating motor 14 which, by way of various linkages and motion drives, operates the sheet perforation device 5, the conveyor means 15 and the auxiliary grippers or tabs 16. It should be noted that the linkages which transmit motion to said devices from the motor 14 may be constructed in any suitable manner, and thus have been represented here in a manner which is diagrammatic for simplicity of drawing and understanding. In this diagrammatic representation, two gear wheels are fixed on to the exit shaft of the motor 14, one of which 17 is connected by a chain 18 to a sprocket wheel 19, on the shaft of which there are mounted a crank 20 and a further gear wheel 21. On a crankpin 20' there is pivoted a connecting rod 22. The opposite end 23 of rod 22 is driven with reciprocating rectilinear motion in both directions, and is connected to a slide block (unnumbered) in a fixed guide (not shown). The slide block is connected by a rod (unnumbered) to a toothed chain 24 passing at its two ends about two pulleys 25 and 25'. On the shaft of this latter pulley 25' there is mounted a unidirectional clutch (not shown) which allows the coaxial pulley 26 to rotate in only one direction, for example when the chain 24 moves in the direction indicated by the arrow F in the figure, i.e. through 180° of rotation of the crank 20, while ramaining at rest for the other 180°, i.e. when the chain 24 moves in the direction opposite to the arrow F. Consequently, a chain 27 passing around the pulley 26 and another gear wheel 28 will move only in the direction of the arrow F' in this example. On the shaft 29 (see FIG. 3) of the gear wheel 28, possibly through a free wheel which takes up the slippage and slack of the transmission, there are mounted the toothed drive pulleys for the endless chains, which are four in number in the represented embodiment, and provide the means 15 for conveying the block of paper P along the inclined surface 2 of the machine, there being provided on the drive chains, in a mutually aligned arrangement at predetermined distances apart, tongues 30 in the shape of a bracket or L, which in turn enter into contact with the block of sheets positioned either by an operator or automatically on the guide 3 at the right hand end of the machine, and push it forwards with intermittent motion, such as to cause the stoppages to coincide with the perforation station 5 and binding station 6. An equivalent number of idle pulleys for the chains 15 are obviously provided mounted on a shaft 29' at the opposite end of the machine, and other intermediate guide pulleys are also preferably provided in order to form free lengths of the upper branch of the chain which are too long, and which could mean that the projection of the tongues 30 from the slots 13 is not guaranteed.

Figure 3:
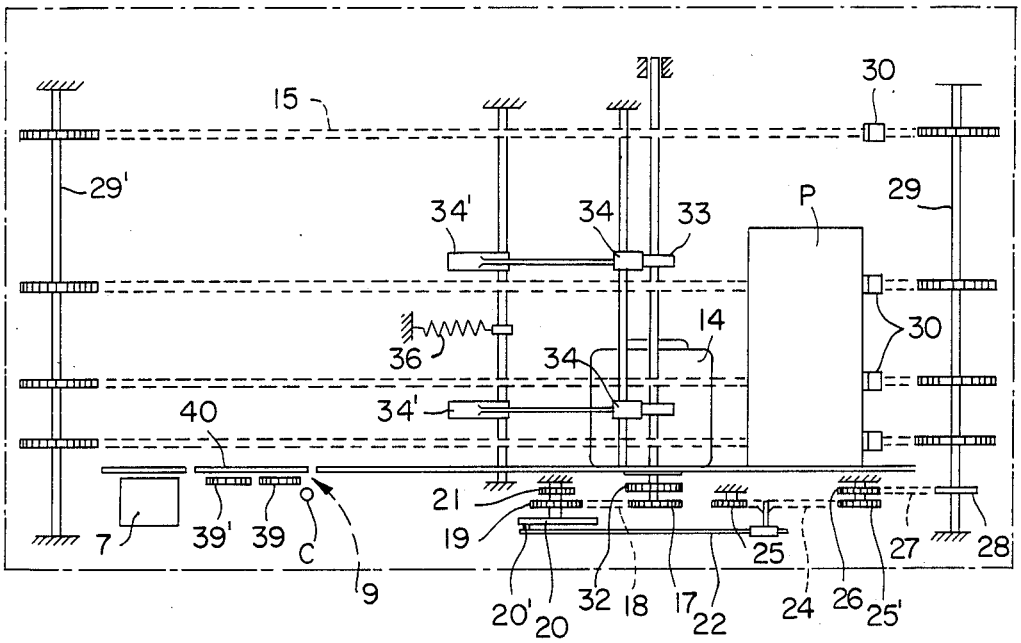
FIG. 3 is a diagrammatic section along the line III—III of FIG. 2.
Figure 4:
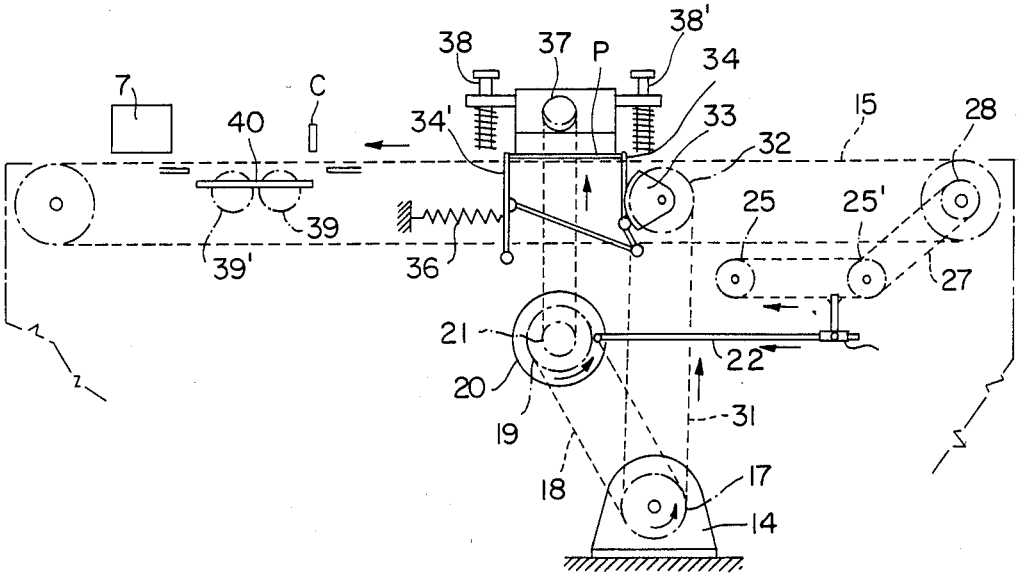
FIG. 4 shows the same representation as in FIG. 2, but at a different operational moment of the machine.

Returning to FIG. 2 and also referring to FIGS. 3 and 4, on the output shaft of the motor 14, coaxial with the pulley 17, there is mounted a further gear wheel (not shown on the drawings) which by way of a further chain 31 drives a toothed pulley 32, on the shaft of which there is fixed at least one cam 33 for controlling the jogger tabs or grippers 34, 34' at the perforation station 5. The movement of this pair of tabs is transmitted simultaneously to the second pair (not shown) provided in front of the binding station 6, and to the single discharge tab, normally of greater length, provided in proximity to the other end of the machine in order to expel the bound block, usually a finished calendar. Obviously wherever a tab or a pair of tabs is mentioned, this means respectively a tab and a pair of tabs for every slot 13 in the machine surface 2, as can be better seen in FIG. 3. In the illustrated embodiment, there is only one cam 33, and this acts directly on the shorter jogger tab 34, which in turn transmits its oscillation by way of a lever system 35 to the second jogger tab 34', to give the latter a wider oscillation which is slightly delayed relative to the movement of the tab 34. Both the tabs are provided with a return spring 36. In a further possible embodiment, the cams mounted on the shaft of the pulley 32 are two in number, and each has a contour which is suitably designed for imparting the required movement to the two sets of tabs 34 and 34'. However, the two cams act directly on two lever arms pivoted at one end and each comprising a return spring, said arms moving in their turn a pair of arms disposed longitudinally to the machine and operating the control lever mechanisms of the one and other set of tabs 34 and 34' respectively. These are mounted preferably on parallel cross members having their ends connected together by a pair of rods, at least one of which is connected to one of said longitudinal arms by means of known lever systems, in such a manner that the position of each tab on its cross member can be adjusted.

Whatever the embodiment used to obtain movement of the tabs 34 and 34', the first of each pair which encounters the advancing block P moves with a smoother "accompanying" movement, during which said tab takes over from the fixed tongue 30 of the chains 15, which are about to stop having arrived in the proximity of one of the stations 5 or 6, whereas the second tab has to make a wider oscillatory movement, which is slightly delayed with respect to the first and in the opposite direction so as to urge the edges of the sheets against the first of the tabs, which is now in contact with the opposite edge, so exerting a "jogger" action to correctly positioning the block in front of one or other station.

With regard to the perforation station, the matrix of punches 11 is operated with a vertical reciprocating movement controlled by at least one eccentric 37, as represented in FIGS. 2 and 4 in the raised position and in the lowered position after perforation, respectively. Two lateral uprights 38 and 38', under the action of a return spring, ensure balanced movement of the matrix. Two eccentrics can obviously be provided, again driven by the main motor 14 by way of the most suitable transmission, each of them acting directly on one of the two uprights 38, 38' to trasmit to them the vertical to-and-fro movement.

In the embodiment shown in FIG. 1, it will be noted that the front part of the perforation device 5 comprises a control and indication panel 10 to which reference is made in greater detail hereinafter, when describing the actual binding device 6. As stated heretofore, this device will be described only with regard to the programmed feed of the binding comb 9 and the electronic programming for controlling the binding operations with reference to FIG. 5. FIG. 3 shows only the two toothed wheels 39 and 39' which independently control the feed of the comb 9, and of which the pitch between one tooth and the next corresponds to the pitch between one loop and the next of said comb, and thus to the distance between one hole and the next as made by the punches 11 in the block of sheets P. The toothed wheels 39 and 39' are also shown in FIGS. 2 and 4 in two different situations with regard to the position of the mobile straight edge 40, which forms the continuation of the guide 3 at the station 6 for inserting and fastening the comb, i.e. the actual binding.

The number of loops B1, spaces B2, repeats B3 and final spaces B4 required for making up the blocks and corresponding to the number and arrangement of the perforation punches in the matrix 11 are set by means of the four selectors 41 provided on the control panel 10. The unit of measurement of the spaces, both intermediate and final, represents the number of loops which would enter said spaces, and past which (empty pitches) the binding comb must be fed before insertion.

Figure 5:
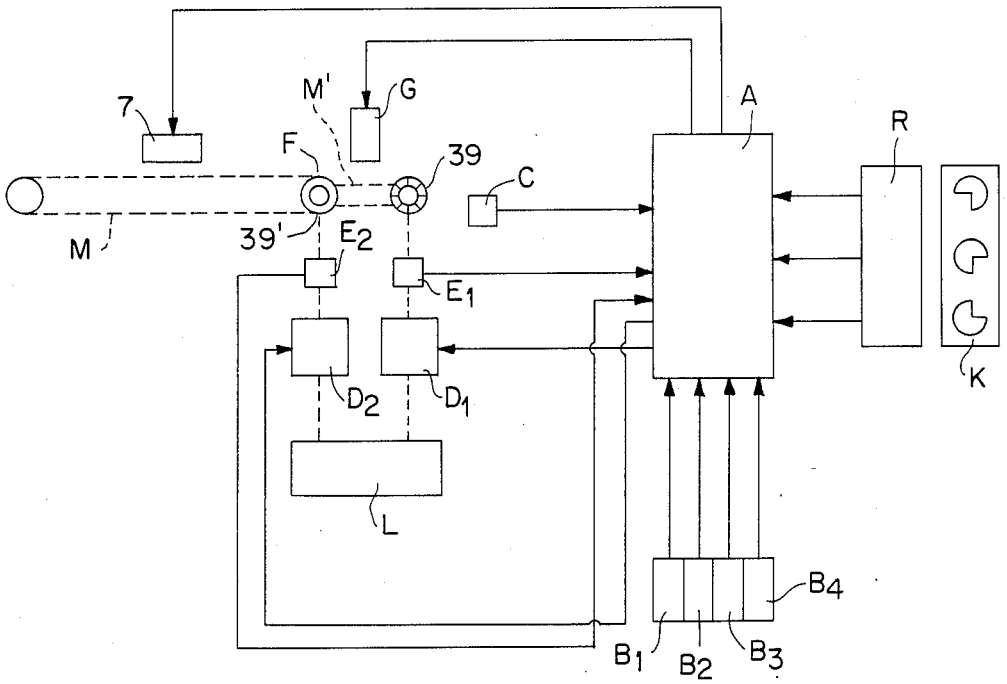
FIG. 5 is a diagrammatic representation, substantially in block form, of that part of the machine downstream of the part shown in FIGS. 2–4, with particular reference to the electronic part.

The two toothed wheels 39 and 39' are each controlled by a brake-clutch motor which is not shown, because of known type, but illustrated diagrammatically in FIG. 5 by the blocks D1 and D2, they being possibly driven by a single drive unit L. On the shaft of each wheel 39 and 39' there is provided a sensor E1, E2 respectively, for detecting the number of loops of the comb 9, for example in the form of counters of revolutions or fractions of a revolution of each wheel or of the number of teeth through which each wheel has rotated.

On start-up, the programmer A initiates the engagement of the clutch of the unit D1, so that by way of a toothed wheel coaxial with the wheel 39, a transmission M' and a further toothed pulley coaxial with the wheel 39', this latter also rotates, together with the toothed belt M, through a number of pitches equal to the programmed number. The comb 9 is thus driven firstly by the wheel 39, then by the wheel 39' until it reaches the toothed belt M, by unwinding from the feed reel 8 and sliding on the lead-in guide 8'. When the pitch detector E1 has counted a number of pitches equal to that set on B1, the clutch is disengaged, and the brake of the unit D1 is applied. Immediately after stoppage, the programmer A activates the solenoid valve which operates the comb cutting unit G disposed between the wheels 39 and 39', so that the piece cut off is free, but while preventing the remaining piece which is still mounted on the wheel 39 from returning backwards, as this latter is braked.

Immediately afterwards, the programmer A engages the clutch of the unit D2, which causes the second wheel 39' and thus the toothed belt M to advance, thus moving forward the piece of comb already cut off. Coaxially to the wheel 39' there is mounted a free wheel unit F which prevents the dragging also of the transmission (chain or gear wheel) M', and thus of the wheel 39 which in the meantime is kept braked by the unit D1. The detector E2 feeds the programmer A with an indication of the number of empty pitches, i.e. without binding, which have passed, and when this number corresponds to the number programmed on B2, the clutch is disengaged and the brake of the unit D2 is applied. Then, if the number set on B3, i.e. the repeats, is equal to two, the clutch of the unit D1 is engaged again for the number of pitches programmed on B1, after which cutting takes place and again the engagement of the clutch of the unit D2, but for the advancement of a number of empty pitches equal not to that set on B2 but on B4, i.e. the final free spaces at the other edge of the block. If however the repeats are more than two, the preceding procedure is repeated to give a number of pieces of comb disposed along the belt M equal to the number programmed on B3, after which, the last cut having been terminated, the procedure described heretofore with reference to the final space is carried out. There is thus a certain number of pieces of comb, all of a determined number of loops, and spaced apart by a certain number of empty spaces, and with a final predetermined empty space. The machine is thus ready for inserting the comb into a block.

Having started the system for feeding the blocks by operating the motor 14, the first block P is conveyed forwards by the tongues or brackets 30 with the said intermittent rectilinear movement. The blocks P pass firstly under the perforating head of the station 5, synchronised with the feed movement, to be acted upon by the positioning and jogger tabs 34, 34' during a pause in the feed. The row of holes corresponds in number and position to the loops and pieces of comb already set on the selectors 41, by using a suitable matrix of punches 11. Continuing its feed, the perforated block P is moved towards the comb inserting unit 6, and at this instant the following operations automatically take place:

(1) A consent photoelectric cell C indicates to the programmer A the presence of a block, and authorizes the reading by the cam position detectors R. The cams K are all mounted on the same shaft of the toothed wheel 32 and of the cam 33 of FIGS. 2 and 4, so that they rotate synchronously with the feed movement, but with continuous, not intermittent motion, and are suitably shaped and positioned so as to supply the detectors R at any moment with the position of the various moving parts, in particular of the conveyor chains 15 and the respective brackets 30, and thus of the blocks P.

(2) Having been authorized by the photoelectric cell C, the various cams indicated diagrammatically by K in FIG. 5 control, by way of the detectors R and programmer A, the various electropneumatic valves for positioning the block, the insertion of the hook by means of the unit 7, the fastening of the comb, etc. These operations can take place in any known manner, for example as described in U.S. Pat. No. 3,854,158 with regard to pressing the comb. With regard to the insertion of the hook reference can be made to Italian patent application 28738 A/76 as the same device can be used.

(3) When the pressing operation and thus the fastening of the comb binding elements in the predisposed holes is terminated, the press opens under the control of the detectors R sensing the instant positions of the cams K. Immediately afterwards, the intermittent motion of the chains 15 and of the brackets 30 moves the block P outside the spiral insertion unit 6 and towards the machine discharge, where the last set of tabs, 42, coordinated with the tabs 34, 34', push the finished block towards the machine discharge.

(4) As soon as the block begins to leave the machine, the preceding cycle of insertion of the spiral based on the program in 41 is repeated automatically, and a further set of pieces of comb is prepared in accordance with the predetermined program. The machine is therefore ready for the next block P.

In addition to the four selectors 41, the panel 10 obviously comprises other controls, indicator lamps, alarms and the general machine start up pushbuttons by which the machine is made to operate completely automatically.

It is apparent that additions and/or modifications can be made by those skilled in the art to the embodiment of the machine according to the present invention as heretofore described and illustrated, without exceeding the scope of the invention. In particular, said machine could be used for normally binding exercise-books, diaries and the like, where there is no need of relatively shifted pieces of comb. In this case the number zero is set on the selector B2, and the number 1 on B3, and the operation of the hook insertion device 7 is simultaneously excluded. The linkages heretofore described can also be of different form, provided that there is a single main motor which controls the feed unit intermittently, the perforation unit and the pairs of jogger tabs in a syncronised manner, such for example as to cause stoppage of the feed chains 15 to coincide with each station 5 and 6, and with the brackets 30 slightly upstream of the leading edge into the station, and to simultaneously operate the tabs 34 and 34' so as to correctly position the block in front of the station, and for example to operate the perforation unit when the block is in front of the station 5.

What I claim is:

1. An automatic machine for perforating and comb binding blocks of sheets, which comprises: a support frame and cover, part of which cover, in the form of an inclined surface, provides support and feed surface for the sheets to be perforated and bound; a sheet perforating station comprising a vertically movable matrix of selectable punches; a reel for supplying comb binding element to the machine; a coupling station for engaging the perforated sheets with one or more portions of the comb binding element which is fed continuously from said reel of two independent feed members; an intermediate cutting member; said coupling station having associated therewith a known hook insertion device; press means of known type; means for conveying the blocks of sheets along said feed surface, said conveying means having associated tab means in proximity to said perforating and coupling stations and in a final discharge zone; cams for operating said tab means for positioning said blocks in front of said stations in correspondence with a stoppage of said conveying means, single motor means for controlling the motion of the conveying means, of said cams and of said punches; and an electronic programmer arranged to receive as input signals originating from detectors sensing the position of the blocks of the sheets, the position of said cams continuously operated by said motor means and the number of loops of the comb being fed, the programmer being able to actuate, as a function of at least one value preset on a selector unit, an operational sequence which controls the fed members of the binding comb, the cutting member, hook insertion, and the closure of the press.

2. A machine as claimed in claim 1, wherein said means for conveying the blocks of sheets comprises a plurality of parallel endless chains operated synchronously at the same speed, said parallel endless chains moving in correspondence with slots provided in said feed surface, there being fixed to each of said chains mutually aligned conveying brackets projecting from said surface through said slots, the chains being driven with intermittent motion, with stoppages provided at least in positions corresponding with said stations.

3. A machine as claimed in claims 2, wherein the period of advancement of said chains has a duration equal to the period of stoppage, each of said periods corresponding to one half of a revolution of a wheel driven by said motor means, the complete revolution of said wheel corresponding to successive periods of advancement and stoppage.

4. A machine as claimed in claim 2, wherein said tab means are moved simultaneously in pairs in front of each station, in each pair the first tab means which is encountered by the block pushed by said conveying bracket having an oscillation more limited than and leading the second, which makes a wider and delayed movement, but in the opposite direction to the movement of the other so as to urge the sheets against this latter and jog their edges.

5. A machine as claimed in claim 2, wherein said cams indicate at any instant the position of the various members in movement, namely at least of the brackets fixed on said chains and of the tab means, the cams being mounted on a shaft which controls the movement of the cams.

6. A machine as claimed in claim 1, wherein said independent feed members are toothed wheels having a pitch equal to that of the loops of the binding comb, the detector for the comb feed being coaxial with said wheels to count the number of pitches through which each wheel rotates, at least one of said wheels being mounted on the side of the cutting member opposite the location at which the comb is fed to the cutting member, to operate a toothed belt of equal pitch for the guided feed of the comb along it.

7. A machine as claimed in claim 6 wherein said toothed wheels are each driven by a brake-clutch unit controlled separately by the electronic programmer and are connected together by a transmission substantially aligned with said toothed belt, whereby when said first wheel becomes a drive wheel by activation of the brake-clutch unit associated therewith the second wheel is also driven by said transmission, a free wheel being further provided coaxially to said second wheel such that when the second wheel becomes a drive wheel by activation of the brake-clutch unit associated therewith and the unit is braked, said transission is not driven by said second wheel.

8. A machine as claimed in claim 6, wherein said toothed wheels are each driven by a brake-clutch unit controlled by said programmer and are connected together by a transmission substantially aligned with said toothed belt, whereby when the first wheel becomes a drive wheel by activation of the brake-clutch unit associated therewith, the second wheel is also driven by said transmission, a free wheel being further provided coaxially to said second wheel such that when the second wheel becomes a drive wheel by activation of the brake-clutch unit associated therewith and the unit is braked, said transmission is not driven by said second wheel.

9. A machine as claimed in claim 1, wherein said selector unit comprises four selectors: a first one for detecting the number of loops on each length of binding comb, a second one for the distance between said lengths of comb, using the comb pitch as the unit of measurement, a third one for repeats, corresponding to the number of said lengths of comb for each block of sheets, and a fourth selector for the final free spaces relative to the edge portion of the block of sheets, this also being counted in terms of comb pitches.

10. A machine as claimed in claim 9, wherein each of said two independent feed members is driven by a brake-clutch unit which is controlled separately by the electronic programmer as a function of the values set on said selectors.

11. A machine as claimed in claim 10, said detector for sensing the position of the blocks of sheets being arranged to recognise the presence of the block in proximity to said coupling station, and to then provide a signal for authorizing said programmer to compare the cam position detectors in order to confirm said presence, and thus to cause said hook insertion device to operate and the press to close, said authorization being given after the final operation of the cutting member and the forward movement of said second wheel operated by the clutch of the brake-clutch unit according to said fourth selector.

12. A machine as claimed in claim 11, wherein before each authorization given by said block position detector, the cutting member is operated a number of times equal to the number set on said repeator third selector.

* * * * *